US006877315B2

(12) United States Patent
Clark et al.

(10) Patent No.: US 6,877,315 B2
(45) Date of Patent: Apr. 12, 2005

(54) HEAT TRANSFER HEAD FOR A STIRLING ENGINE

(75) Inventors: David Antony Clark, Hugglescote (GB); James Robert Lowrie, Derby (GB)

(73) Assignee: MicroGen Energy Limited (GB)

( * ) Notice: Subject to any disclaimer, the term of this patent is extended or adjusted under 35 U.S.C. 154(b) by 0 days.

(21) Appl. No.: 10/344,714

(22) PCT Filed: Aug. 14, 2001

(86) PCT No.: PCT/GB01/03637

§ 371 (c)(1),
(2), (4) Date: Jun. 30, 2003

(87) PCT Pub. No.: WO02/14671

PCT Pub. Date: Feb. 21, 2002

(65) Prior Publication Data

US 2004/0006982 A1 Jan. 15, 2004

(30) Foreign Application Priority Data

Aug. 15, 2000 (GB) ..... 0020012

(51) Int. Cl.[7] ..... F02G 1/55; F02G 1/04; F02G 1/43; F02G 1/53; F25B 9/00

(52) U.S. Cl. ..... 60/517; 123/41.69; 165/51

(58) Field of Search ..... 60/524, 526, 517; 123/41.69; 165/51

(56) References Cited

U.S. PATENT DOCUMENTS

| | | | | | |
|---|---|---|---|---|---|
| 4,483,143 | A | | 11/1984 | Corey | 60/526 |
| 4,527,394 | A | * | 7/1985 | Corey | 60/526 |
| 6,381,958 | B1 | * | 5/2002 | Kamen et al. | 60/524 |
| 6,694,731 | B2 | * | 2/2004 | Kamen et al. | 60/524 |
| 6,715,285 | B2 | * | 4/2004 | Isaac, Jr. | 60/524 |

FOREIGN PATENT DOCUMENTS

| | | | | |
|---|---|---|---|---|
| BE | 405953 | | 11/1934 | |
| JP | 57113938 A | * | 7/1982 | F02G/1/053 |
| JP | 60101254 | | 7/1984 | |
| JP | 61265344 | | 5/1985 | |
| JP | 01244151 | | 3/1988 | |

* cited by examiner

*Primary Examiner*—Sheldon J Richter
(74) *Attorney, Agent, or Firm*—Needle & Rosenberg, P.C.

(57) ABSTRACT

A heat transfer head (10) for a stirling engine is disclosed. The heat transfer head (10) comprises a plurality of external circumferential fins (30) projecting out from the heat transfer head (10). At least two of the adjacent fins (30) are arranged to be substantially parallel and such that some of the radiant heat received by one of the fins is reflected onto the other fin. A second set of fins (40) is provided above the circumferential fins. The second set of fins are arranged to enable combustion gases from a burner to pass upwards therebetween to enable heat to be absorbed from the passing combustion gases.

8 Claims, 4 Drawing Sheets

HEAT TRANSFER HEAD FOR A STIRLING ENGINE

CROSS REFERENCE TO RELATED APPLICATIONS

The present patent application claims priority to International Application No. PCT/GB01/03637 filed Aug. 14,2001, and Great Britain Patent Application No. 0020012.1, filed Aug. 15, 2000, each of which is incorporated by reference as if fully set forth herein.

FIELD OF THE INVENTION

The present application relates generally to a Stirling engine. More specifically, the invention relates to a heat transfer head for use with a Stirling engine.

BACKGROUND OF THE INVENTION

A Stirling engine is an externally heated reciprocating engine. It has a cylinder within which oscillation of a piston or pistons serves to move a working fluid between hot and cold heat exchangers and provide power output.

Heat is generally supplied to one end of the cylinder of the Stirling engine in order to heat the gas inside and drive the working piston. The end of the Stirling engine which is heated is called a heat transfer head and is generally surrounded by an annular heater or burner, which supplies heat to the heat transfer head. The cylinder is generally arranged vertically, with a burner surrounding it to supply heat so that hot exhaust gases from the burner can escape upwards. In order to enhance the transfer of heat to the cylinder of the Stirling engine to increase its efficiency the heat transfer head can be provided with fins to increase-its surface area.

SUMMARY OF THE INVENTION

It is an object of the present invention to enhance the transfer of heat to the heat transfer head.

According to the present invention there is provided a heat transfer head for a Stirling engine having an axis of reciprocation, the head comprising a plurality of external fins providing a first set with each fin projecting out from the heat transfer head and having a length, a first side and a second side and at least two of the adjacent fins being arranged such that at least a portion of their lengths are substantially parallel and arranged such that at least a portion of any radiant heat received on a side of one of the two adjacent fins is reflected onto a side of the other fin, wherein a second set of fins is provided above the first set, each of the second set of fins having a length, a first side and a second side and the length of each of the second plurality of fins extending in a plane, in use, extending in the direction of the axis of the heat transfer head.

Heat is absorbed by the first set of fins at each reflection, so that by arranging the fins such that radiant heat is reflected between two substantially parallel adjacent fins, more of the heat energy is absorbed due to the multiple reflections providing a more efficient heat transfer. The arrangement of the second set of fins enables combustion gases from the burner to pass upwards therebetween to enable heat to be absorbed from the combustion gases.

At least a portion of the radiant heat reflected onto the side of the other substantially parallel fin is preferably reflected back to the one fin to further enhance the heat transfer.

The neighbouring sides of two adjacent fins may diverge as they extend away from the heat transfer head to provide an overall saw tooth cross-section with each fin having a substantially triangular or truncated triangular cross-section. This reduces radiant heat transfer from the fin tips back to the burner, external walls and hot gases.

The length of the fins may extend around the periphery or circumference of the Stirling engine which increases the physical strength of the heat transfer head.

At least some of the external fins which are arranged to reflect radiant heat between each other are preferably arranged to be positioned substantially opposite a source of radiant heat such as a heater or a burner.

In order to improve the heat transfer, each of the second set of fins is attached, in use, to a cylindrical part of the Stirling engine and has an extended portion extending above the cylindrical part but not being directly attached to the Stirling engine. In order to improve the stability of this and other arrangements, the second set of fins are preferably connected by a circumferential ring.

BRIEF DESCRIPTION OF THE DRAWINGS

Examples of heat transfer heads illustrating the present invention will now be described with reference to the accompanying drawings in which.

DETAILED DESCRIPTION

Figure 1:
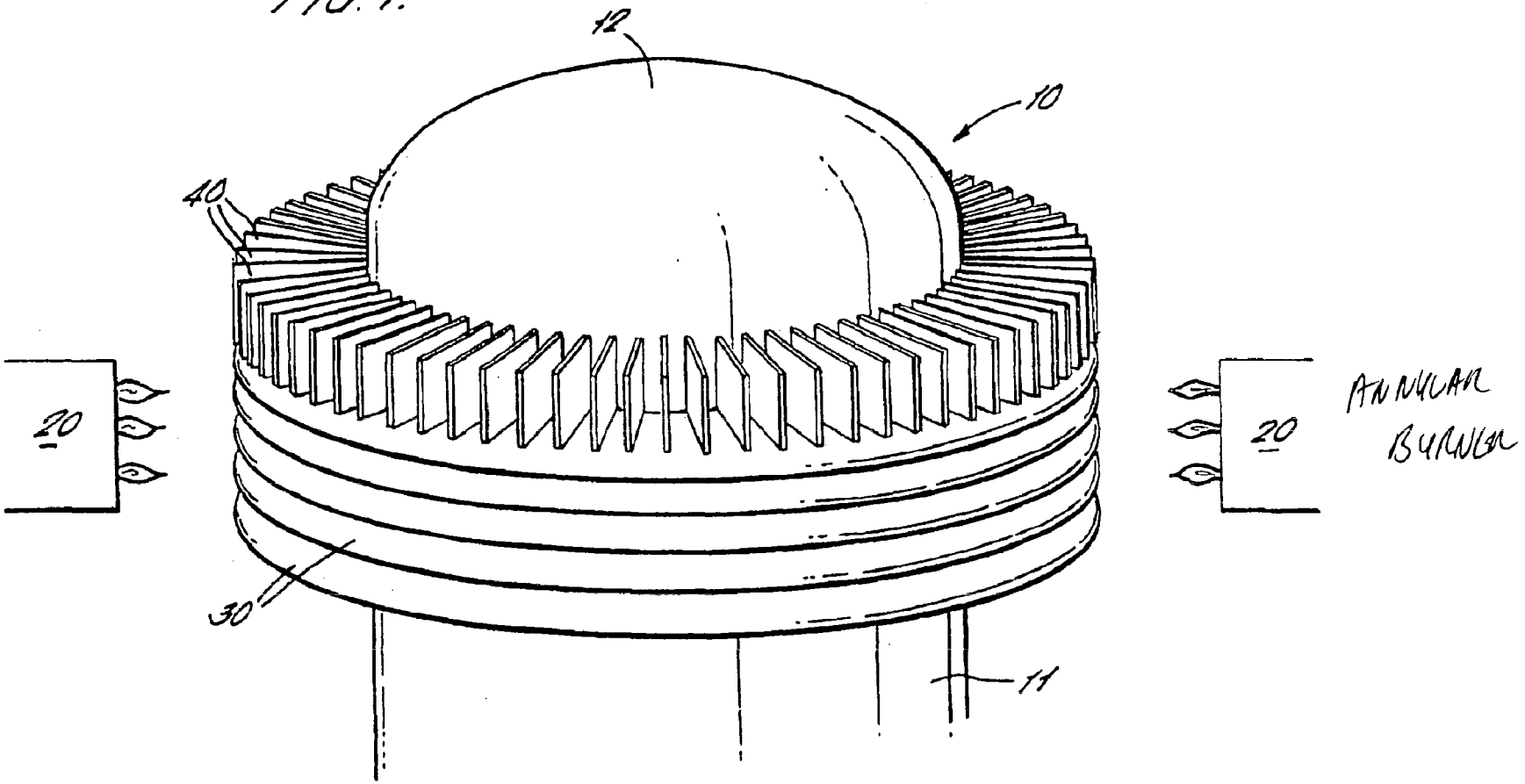
FIG. 1 is a perspective view of a heat transfer head.

The heat transfer head 10 illustrated in FIG. 1 forms the top of a Stirling engine. The head 10 is in the form of a cylinder 11 with a dome 12 at one end. An annular burner 20 is shown schematically. The. burner 20 surrounds the heat transfer head 10 and is arranged to supply it with heat to make the Stirling engine operate. The burner 20 in this example is powered by natural gas.

The heat transfer head 10 is provided with a plurality of elongate first fins 30 the length of each of which extends circumferentially around the cylindrical portion of the heat transfer head 10. The aspect ratio of the first fins 30 is such that the gap 4 between adjacent fin tips is small compared to the fin height 5. The heat transfer head 10 is also provided with a plurality of second fins 40, the length of each of which extends longitudinally in the direction of the axis of the cylindrical portion 11 of the heat transfer head. The second fins 40 are arranged in radial planes around the heat transfer head 10.

Figure 2:
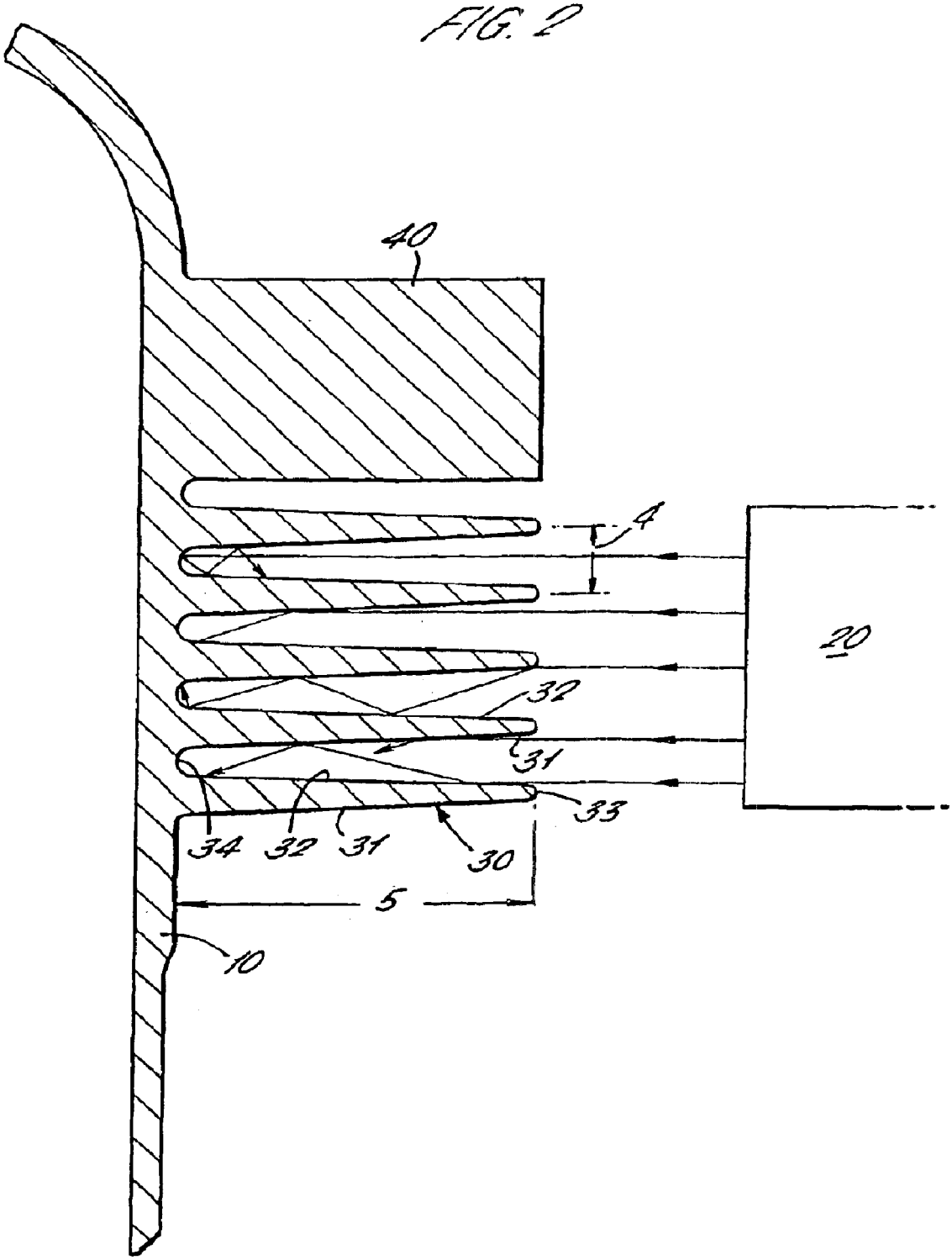
FIG. 2 is across-sectional side view of the fins of the heat transfer head shown in FIG. 1.

As shown in FIG. 2 each fin 30 has a first under side 31 and a second upper side 32. The sides 31, 32 of each fin are substantially flat and converge towards each other as they extend away from the heat transfer head 10. The cross-section of the tip 33 of each fin 30 where the two sides 31, 32 converge is shown in FIG. 5 as being curved but could be a point or any other suitable cross-section. The cross-section of the area 34 where the bases of two adjacent fins 30 are joined to the heat transfer head 10 is also shown in FIG. 2 as being curved but it could be any suitable cross-section. Each fin 30 in this example has a height 5 of about 25 mm from the wall of the heat transfer head 10 to its tip 33 and the gap 4 between the tips 33 of adjacent fins 30 is about 5 mm. The height 5 of each fin is preferably more than twice the distance between tips 33 of adjacent fins 30 to promote reflection of radiant heat on the fins. However, the height 5 of each fin may be three, four or five times the gap 4 between tips 33 of adjacent fins 30.

A source of radiant heat, in this case a burner 20, is arranged opposite to the plurality of fins 30 such that radiant heat is directed into the spaces between adjacent fins 30. As can be seen in FIG. 2, radiant heat impinging on one of the sides 31, 32 of a fin 30 is reflected to the neighbouring side of the adjacent fin 32, 31. At each reflection heat is absorbed by the fin 30 of the heat transfer head 10 and used to operate the Stirling engine. The triangular structure of each fin 30 producing an overall saw tooth shape may produce multiple reflections of radiant heat between each pair of fins 30 with each reflection enabling the heat transfer head 10 to absorb more heat.

When radiant heat reaches the point 34 at which two adjacent fins 30 meet, the radiant heat is reflected away from the heat transfer head 10 and may encounter more reflections against the fins 30 on its passage away from the heat transfer head 10 enabling the heat transfer head 10 to absorb yet more heat.

Above the first fins 30, FIG. 2 shows the cross-section of one of the second fins 40 in a plane extending in the direction of the axis of the cylindrical portion of the heat transfer head 10. Hot combustion gases from the burner 20 pass upwards between adjacent second fins 40 and much of the heat from the combustion gases is absorbed by the fins 40.

Fins 40 are arranged to maintain high gas velocity and have a high convective heat transfer coefficient. The fins 40 preferably have a rectangular cross-section to increase fin efficiency. The heat transfer head 10 is arranged relative to the heat source 20 such that radiant heat is directed from the heat source into the spaces between adjacent fins 30. The second fins are preferably arranged above the heat source 20 to absorb heat from rising combustion gases. In this arrangement a greater proportion of heat from the heat source 20 is absorbed by the heat transfer head 10, increasing efficiency.

Figure 3:
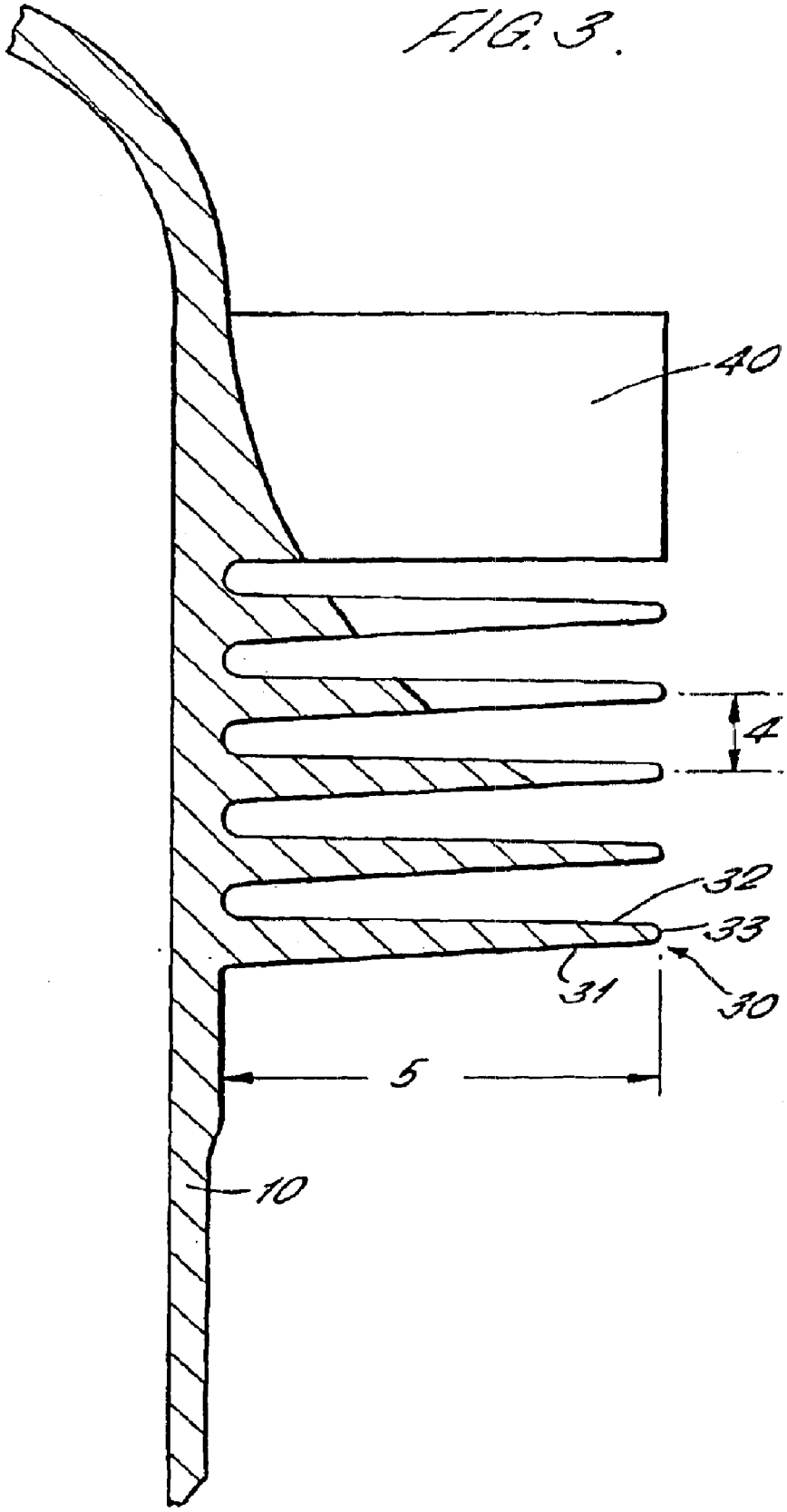
FIG. 3 is a cross-sectional side view of an alternative set of fins for the heat transfer head.

FIG. 3 shows an alternative arrangement of fins for a heat transfer head 10. The fins shown in FIG. 3 are identical to those shown in FIG. 2 except that channels have been made transversely into the sides of fins 30 at points spaced circumferentially around the heat transfer head 10. The channels extend in the direction of the axis of the cylindrical portion of the heat transfer head 10. The channels extend further into the sides of the fins 30 nearer to the top of the heat transfer head 10 to accommodate an increasing flow of combustion gases. The channels may be cut in the fins 30 using a circular saw.

The fins may be made from any suitable heat conducting material such as metal, usually steel. The heat conducting head 10 and fins 30, 40 may be formed from the same integral piece or separate pieces of material brazed to the cylindrical part of the head to enhance heat conduction from the fins 30, 40 to the heat conducting head 10.

Additional circumferential slots may be used in the fin section 40 for stress relief purposes depending upon cylinder design and operating pressures and temperatures.

Figure 4:
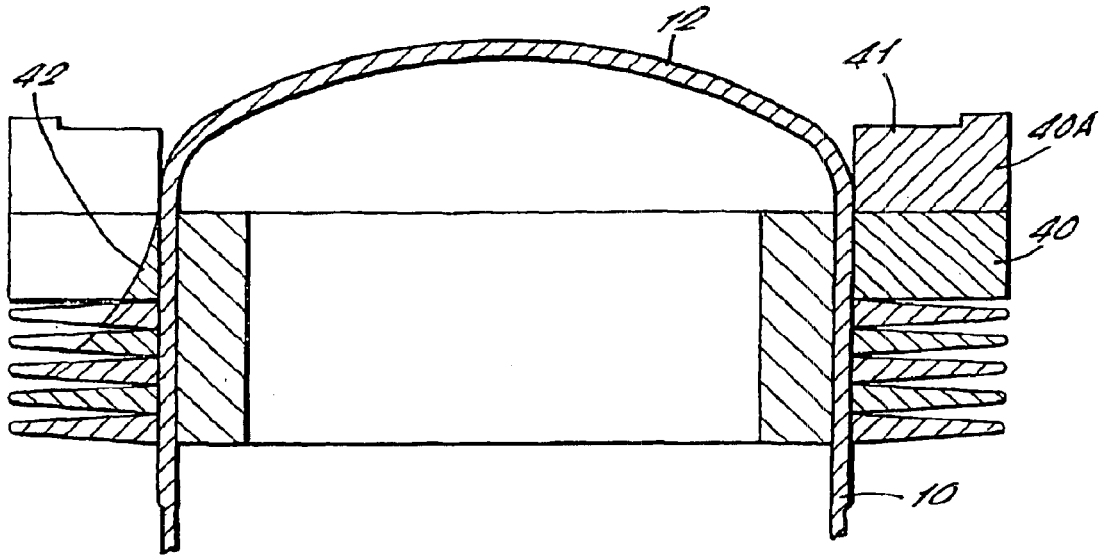
FIG. 4 is across-sectional side view of a second alternative set of fins for the heat transfer head.

FIG. 4 shows an alternative arrangement of fins for a heat transfer head 10. This arrangement is broadly the same as that shown in FIG. 2. In addition, this arrangement may incorporate channels as shown in FIG. 3. In this arrangement, the fins 40 have an extended portion 40A extending above the cylindrical portion of the heat transfer head. However, the fins 40 are only attached to the cylindrical portion of the head and there is a clearance between the dome 12 and the extended portion 40A of the fins 40.

A ring 41 extends around the outer peripheral edge of the upper surfaces of the extended portion 40A thereby connecting the fins 40 together. A second circumferential ring 42 of triangular cross-section extends around the lower inner part of the fins 40. This provides a rigid structure allowing the fins to be manufactured and installed as a single component. The extended fins allow a higher level of heat transfer from the burner gases with all of this conduction occurring through the lower part of the fin which is attached to the head 10.

What is claimed is:

1. A Stirling engine having a heat transfer head having an axis of reciprocation, the head comprising a plurality of external fins providing a first set with each fin projecting out from the heat transfer head and having a length, a first side and a second side and at least two of the adjacent fins being arranged such that at least a portion of their lengths are substantially parallel and arranged such that at least a portion of any radiant heat received on a side of one of the two adjacent fins is reflected onto a side of the other fin, wherein a second set of fins is provided above the first set, each of the second set of fins having a length, a first side and a second side each of the second plurality of fins being positioned in a plane, in use, extending in the direction of the axis of reciprocation of the heat transfer head, and wherein neighboring sides of two adjacent fins in said second set of fins diverge as they extend away from the heat transfer head.

2. The Stirling engine of claim 1, wherein each fin has a substantially triangular or truncated triangular cross-section.

3. The Stirling engine of claim 1, wherein the length of the fins of the first set extends about the periphery of the Stirling engine.

4. The Stirling engine of claim 1, wherein the second set of fins are connected together by at least one circumferential ring.

5. The Stirling engine of claim 1, wherein the heat transfer head is operably coupled to a Stirling engine.

6. The Stirling engine of claim 1, wherein at least some of the fins of the first set are arranged to be positioned substantially opposite to a source of radiant heat such that the radiant heat can be directed onto both sides of at least some of the fins.

7. The Stirling engine of claim 6, wherein at least some of each of the second set of fins extends vertically above the source of radiant heat.

8. A Stirling engine having a heat transfer head having an axis of reciprocation, the head comprising a plurality of external fins providing a first set with each fin projecting out from the heat transfer head and having a length, a first side and a second side and at least two of the adjacent fins being arranged such that at least a portion of their lengths are substantially parallel and arranged such that at least a portion of any radiant heat received on a side of one of the two adjacent fins is reflected onto a side of the other fin, wherein a second set of fins is provided above the first set, each of the second set of fins having a length, a first side and a second side each of the second plurality of fins being positioned in a plane, in use, extending in the direction of the axis of reciprocation of the heat transfer head, wherein each of the second set of fins is attached, in use, to a cylindrical part of the Stirling engine and has an extended portion extending above the cylindrical part but not being directly attached to the Stirling engine.

* * * * *